US005174148A

United States Patent [19]

Thomas et al.

[11] Patent Number: 5,174,148

[45] Date of Patent: Dec. 29, 1992

[54] BRACE

[76] Inventors: Leroy Thomas, 8242 Caddo, Houston, Tex. 77078; Juan Hernandez, 9703 Agulia, Houston, Tex. 77015

[21] Appl. No.: 694,348

[22] Filed: May 1, 1991

[51] Int. Cl.[5] ..... B66F 3/00

[52] U.S. Cl. ..... 72/392; 72/705; 254/93 R

[58] Field of Search ..... 72/392, 705; 254/93 R

[56] References Cited

U.S. PATENT DOCUMENTS

| | | | |
|---|---|---|---|
| 1,850,073 | 3/1932 | Countryman | 72/705 |
| 2,010,713 | 8/1935 | Countryman | 72/705 |
| 2,185,550 | 1/1940 | Gerdes | 72/705 |
| 4,762,304 | 8/1988 | Hill | 72/705 |
| 4,783,053 | 11/1988 | Yirmiyahu et al. | 72/705 |

FOREIGN PATENT DOCUMENTS

| | | | |
|---|---|---|---|
| 2908172 | 9/1980 | Fed. Rep. of Germany | 72/392 |

OTHER PUBLICATIONS

"Kansas Jack Collision Repair Equipment", Jan. 12, 1982, p. 20.

*Primary Examiner*—David Jones

*Attorney, Agent, or Firm*—David M. Ostfeld

[57] ABSTRACT

A brace for use in a door frame of a vehicle to brace an hydraulic ram in order to move the front interior portion of the vehicle away from the seats of the vehicle is disclosed. The brace includes a frame for fitting over the horizontal portion and "B" post of the door frame. The brace includes a brace mechanism that is self-locking with the brace frame through means of opposing sets of openings formed in the sides of the brace frame. The brace has a handle and brace pin which is inserted into the openings. The brace pin has a notch at the end farthest from the handle portion. Notch openings are formed horizontally on each of the openings on the sides of the frame. Accordingly, when the pin portion is inserted through the side openings, the notch fits through the notch openings and then gravity rotates the handle downward thereby locking the notch against the farther side of the brace frame. A secondary lock clip is also provided which fits into a hole within the pin to further lock the pin portion of the brace mechanism. The foot of the hydraulic ram rests against the pin portion. Stability bars are provided in the vertical portion of the frame to fit the vertical portion of the door frame there between.

16 Claims, 3 Drawing Sheets

BRACE

BACKGROUND OF THE INVENTION

1. Field of the Invention

The invention relates generally to an improved rescue brace. In particular the invention relates to a rescue brace for vehicles which facilitates easier, faster removal of steering columns and dashboard away from pinned victims.

2. Description of the Art

In 1986, more than 44,000 people were killed on America's highways. This number is approximately ten times the number of people who were killed in fires that year. In addition there are thousands of injuries per year on the highways. There is a need for fast and efficient release of victims trapped in vehicles so the emergency personnel can transport the victim to an emergency medical hospital.

Devices for removing a steering column and dashboard from a victim are old in the art. The Seminole County Fire Department has produced a piece of four inch rail bent at a 90° angle with a short vertical side and a longer horizontal side. For this device, stop blocks were welded at regular intervals on the horizontal surface of a fitting. This device is dropped over the exposed rocker panel or bottom rail of the door frame of a vehicle. The shorter vertical side is fitted up against the "B" post of the vehicle. Thus there are two brace surfaces of the vehicle against the surfaces of the device which must be maintained. Chains, cribbing and jaws of life are also used to extricate the injured from entrapment in vehicles. The problem with these other tools currently in use is that they are time consuming for set up, and some of them must be readjusted several times, causing the steering column or dashboard to fall back onto the injured party.

It is an object of the invention to provide a rescue brace which is more rapidly applied using less equipment than previous methods.

SUMMARY OF THE INVENTION

The device of the present invention is a supporting brace that has an adjustable gravity locking pin for a snug fit for ram bars and in some cases jaws of life in rescue extrication of trapped victims of vehicle accidents. It is configured to reinforce rocker panels and "B" posts on four door, two door and the small foreign vehicles. The invention is formed to also be compatible with most major brands of ram bar and Jaws model in rescue service. The invention makes it possible to use different sizes of hydraulic ram bars and also to be used when the bottom of the "B" post is too weak to hold up under the stress of the ram, during extrication of the injured.

The brace is L-shaped with a lower section sized to firmly sit on the bottom and side of the door opening. The brace has two internal channels with opposing openings in the sides of the upper channel which are spaced to receive one or more gravity pins adapted to hold, for example, a hydraulic ram. Because of the variation of pivot points, this device can be used with one or two ram bars of different sizes. Stability bars are provided on the lower channel of the brace to enable the devise to assume a secured, anchored position.

The device is easy to operate and set-up in place for a vehicle that has suffered a front end roll over or other operation that has caused the front end to trap a victim.

The brace is placed over the bottom rail of the door frame. A cut is made on the "A" post, level to the dashboard. Next a cut is made on the bottom rail of the door frame. A rescuer can place a gravity locking pin in the best setting of the opposing pivot holes for maximum use of the ram bars or jaws of life. Stability bars provided at the rear of the brace help keep it from shifting from a secured hold under pressure. Thus, upon activation, upward pressure from the extending ram bars on "A" post will displace the steering column or dashboard.

The device could also be used when the bottom of the "B" post was too weak to hold up under the stress of the ram during the removal of the steering column or dashboard away from an entangled victim by locating different ram bars to redistribute load around the door frame.

BRIEF DESCRIPTION OF THE DRAWINGS

For a further understanding of the nature and objects of the present invention, reference should be had to the following drawings in which like parts are given like reference numbers and wherein.

DESCRIPTION OF THE PREFERRED EMBODIMENT

Figure 1:
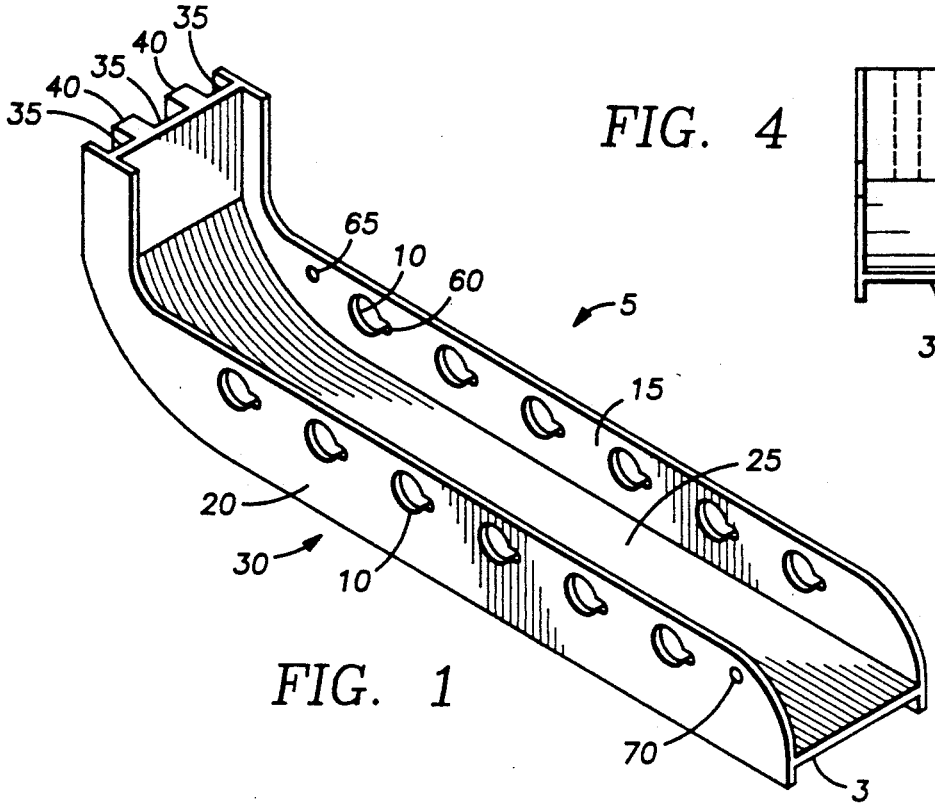
FIG. 1 is an isometric view of the brace of the preferred embodiment of the present invention.
Figure 4:
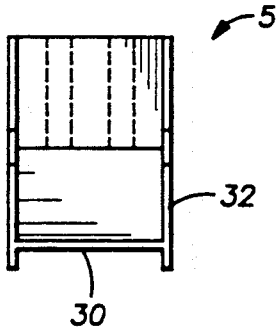
FIG. 4 is an end view of the brace of the preferred embodiment of the present invention.

The adjustable brace 5 is shown is FIG. 1. The brace 5 has opposing sides 15,20 separated by a bottom plate 25. The separation by bottom plate 25 forms a lower channel 30 and an upper channel 32 (FIG. 4). The brace 5 includes sets of opposing pivot holes 10 formed in sides 15,20 with a notch 60 cut on the side of each hole 10 of sides 15,20 closest to the end 31 of plate 25. Typically, sides 15,20 have six pivot holes 10 spaced apart along each side 15,20 with a notch cut 60 on each hole 10.

As shown in FIG. 1, indicator holes 65, 70 are also formed in the sides 15,20, respectively. Rear indicator hole 65 is on right side 15 (right side facing end 31), and front indicator 70 is on left side 20 of brace 5. Front indicator hole 70 is the hole closest to end 31, and rear indicator hole 65 is the hole farthest from end 31.

Bottom channel 30 of brace 5 includes an outer ridge, such as a ½" ridge, on the bottom of both sides 15,20 running the length of bottom channel 30. For example, it may measure 19-3/16" in length, and then curve to a 90° orientation with its horizontal length to run vertically up the back 35 of brace 5 (FIG. 2).

Figure 2:
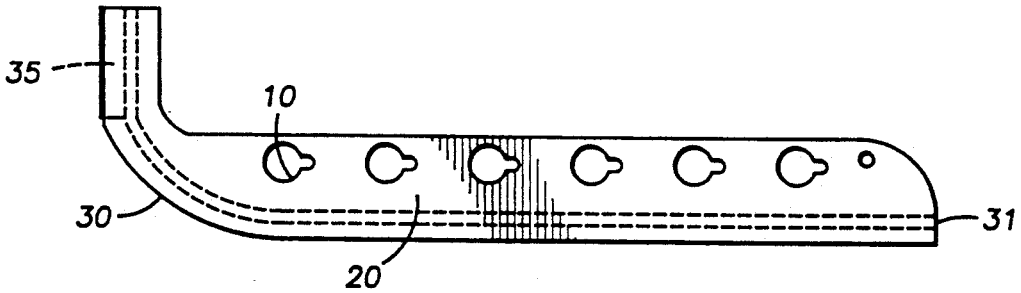
FIG. 2 is a side view of the brace of the preferred embodiment of the present invention.
Figure 3:
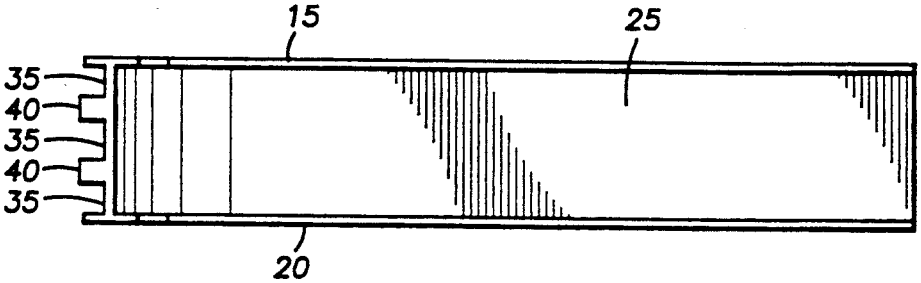
FIG. 3 is a plan view of the brace of the preferred embodiment of the present invention.

On back side 35, there are also included two stability bars 40 typically 3-1/16" long × ⅜" sq. in. thickness with a 1-1/16" of space between each other, as shown in FIGS. 1, 2 and 3.

Typically, the height of brace 5 is 6½" with a width of 4-23/32" between sides 15,20.

As shown in FIG. 3, the horizontal length of bottom plate 25 of brace 5 is typically 24-4/8" in length with the horizontal portion being 19-3/16" in length typically and the curved portion commencing from the end of the horizontal portion until the curve reaches a vertical rise, which vertical rise is typically 3-1/16" long. The notch cuts 60 are typically ⅜" by ⅜", and openings 10 are spaced between 2-15/16" and 3-1/16" center to center with diameters of 7/8" to 1".

Figure 6:
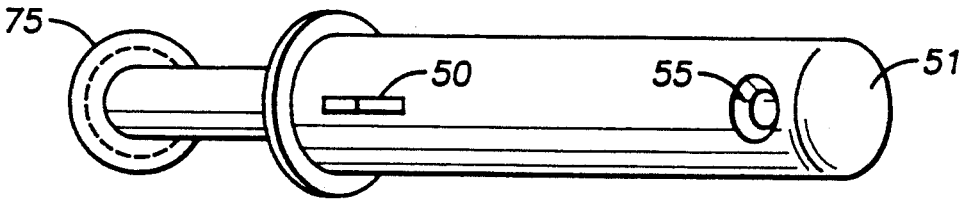
FIG. 6 is a plan view of the gravity pin of the brace of the preferred embodiment of the present invention.
Figure 5:
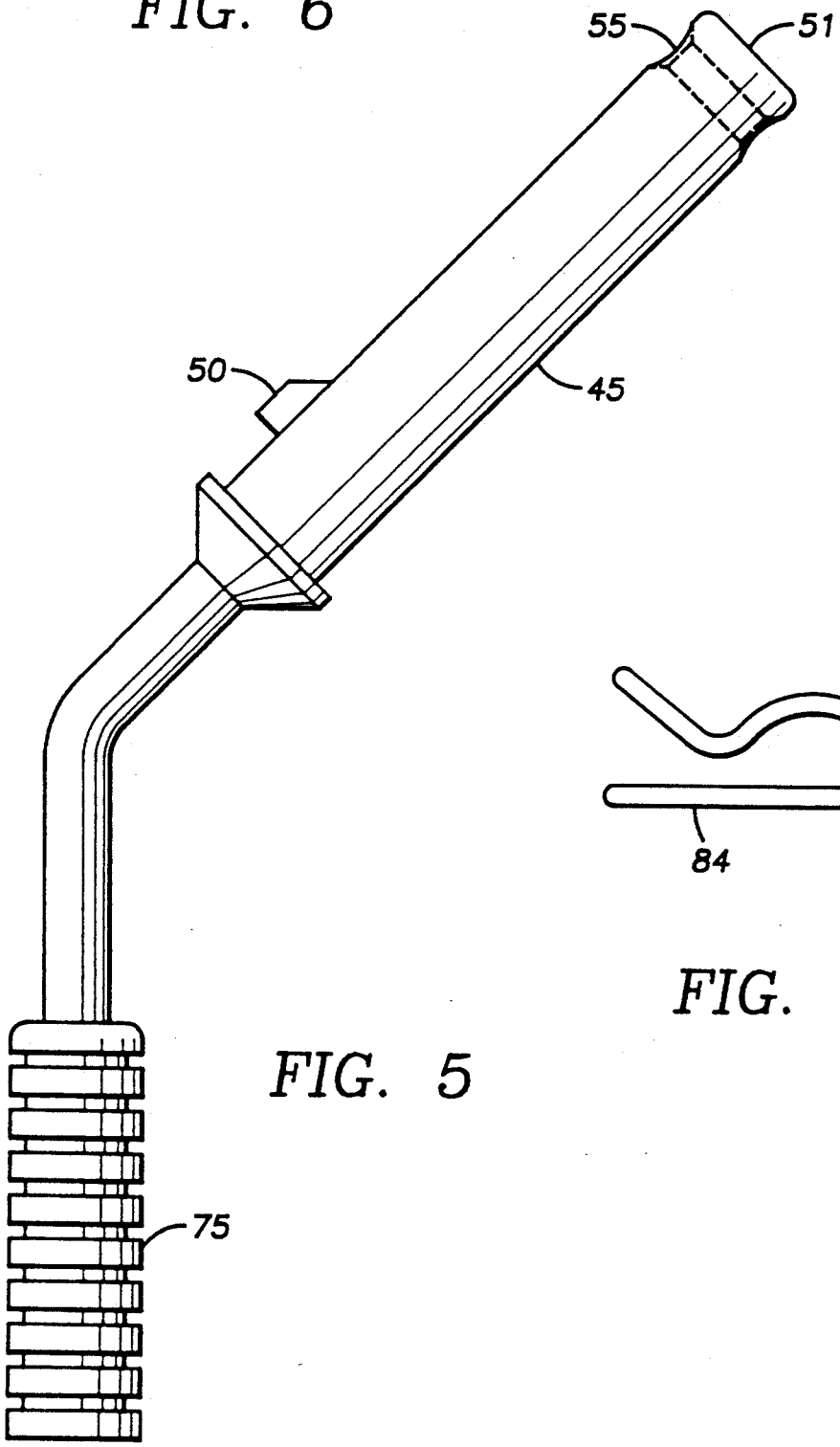
FIG. 5 is a side, elevated view of the gravity pin of the brace of the preferred embodiment of the present invention.
Figure 7:
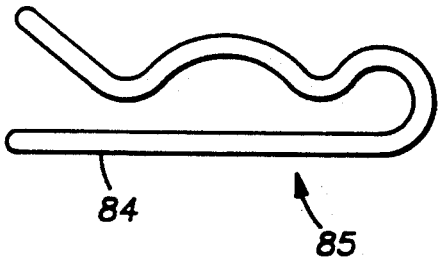
FIG. 7 is a side, elevated view of the slip pin of the brace of the preferred embodiment of the present invention.

As shown in FIGS. 5 and 6, a gravity locking pin 45 has a lock notch 50. Locking pin 45 with notch 50 are sized to slide through opposing pivot holes 10 with notch cuts 60 on either side 15, 20 in the upper channel 32 of the brace 5. Locking pin 45 includes a handle grip 75. The weight of the handle grip 75, which may be more heavily weighted on the side opposite to lock notch 50 to be off center, turns gravity lock pin 45. Therefore after insertion in holes 10, the handle 75 will rotate to move the lock notch 50 away from alignment with notch cut 60 to lock the locking pin between sides 15, 20. A secondary lock system to maintain the gravity locking pin 45 in position is also provided. The locking pin 45 includes a back-up hole 55 such as ¼" drill hole, formed at the end 51 of gravity locking pin 45. Hole 55 is sized to receive the substantially uniform end 84 of a slip pin clip 85 (FIG. 7). The pin handle grip 75 has grooves typically 5/32" apart and 3/32" depth for a firm grip when gloves are worn.

Thus the brace 5 is a supporting tool, typically 24-4/8" in length that a 90° curve at the rear of it. It has for example six pivot holes 10 on each side. A gravitational lock pin 45 that has a notch 50 on top is provided for bracing for a hydraulic ram and for being locked in place. The hole 55 at the end of the pin 45 is a secondary lock that a slip clip 85 can slide in. The locking pin 45 may be slid into holes on either side 15,20 of the brace 5.

Typically the brace is made of metal, such as iron steel or aluminum.

Figure 8:
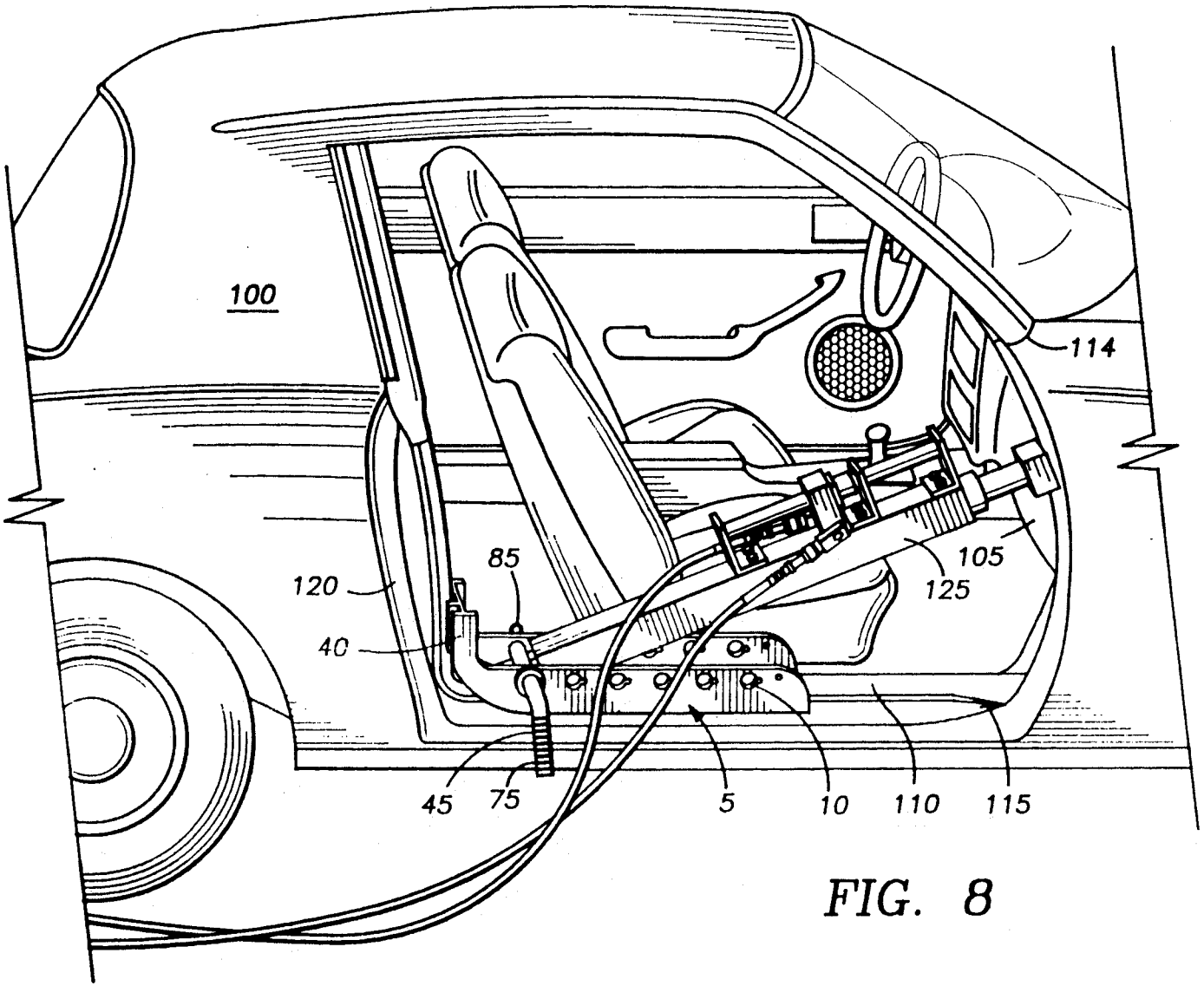
FIG. 8 an isometric view of the brace of the preferred embodiment used with an automobile.

As shown in FIG. 8, in use, in a vehicle 100 the brace 5 is positioned to force the dashboard 105 away from the victim (not shown). For this purpose the lower channel 30 is placed over the bottom rail 110 of the door frame. A cut 114 is made on the "A" post, level to the dashboard 105. Next a cut 115 is made on the bottom rail 110 of the door frame. The brace 105 has its stability bars 40 positioned such that the "B" post 120 is between them. The rescuer then locates the best set of pivot holes 10 in which to insert gravitational lock pin 55. As seen in FIG. 8, after the gravitational lock pin is inserted with notch 50 fitting through notch hole 60 while the end 51 inserts through opposing holes 10, the grip 75 is released which will then rotate downwardly. This moves notch 50 out of alignment with notch hole 60. As discussed above, clip 85 may then have its side 84 slipped through hole 55 further locking the gravitational lock pin 55 in place as a brace for one end of hydraulic ram bar 125. Hydraulic ram bar 125 can then be activated against dashboard 105 to force dashboard 105 away from the victim (not shown). If necessary, a second gravitational lock pin 55 (not shown) may be inserted into another set of pivot holes 10 to serve as a second position for a second hydraulic ram bar (not shown) to further force the dashboard 105 away from the victim (not shown).

The instant invention has been disclosed in connection with a specific embodiment. However, it will be apparent to those skilled in the art that variations from the illustrated embodiments may be undertaken without departing in the spirit and the scope of the invention. For example, any dimension can be used. In addition, further reinforcement may be made by cross pieces to lighten the material of construction.

Accordingly, because many varying and different embodiments may be made within the scope of the inventive concept herein taught including equivalent structures or materials hereafter thought of, and because many modifications may be made in the embodiments herein detailed in accordance with the descriptive requirements of the law, it is to be understood that the details herein are to be interrupted as illustrative and not in a limiting sense.

What is claimed is:

1. A brace for use in a door frame of a vehicle, the door frame having a horizontal portion and a vertical portion, the brace used in conjunction with an hydraulic ram, which ram includes a foot, comprising:

a frame, said frame having two sides and a cross member connected to each of said sides, said cross member dividing said frame into an upper and lower channel, each of said sides and cross members having a bend at one end such that said frames have a vertical portion at one end and a horizontal portion at the other end;

said lower channel being sized to fit over the horizontal portion of the door frame and over a vertical portion of the door frame;

brace means removably mounted on said frame for bracing the foot of the hydraulic arm; and lock means for locking said brace means to said frame.

2. The brace of claim 1, wherein said brace means includes:

a plurality of sets of opposing holes having centers and perimeters, said holes are formed in and extending through each of said sides;

a locking pin sized to fit through one set of said opposing holes and being of sufficient thickness to brace the foot of the hydraulic ram without yielding.

3. The brace of claim 2, wherein said lock means includes a plurality of sets of opposing notch openings extending through said sides, said notch openings being connected with said perimeter of said holes and having a center of curvature; and said brace means further includes a lock notch formed on one side of said locking pin and sized to fit through a set of said notch openings.

4. The brace of claim 3, wherein said lock means further includes:

a handle connected to said locking pin; and said center of curvature of said notch openings and said centers of said holes being in a plane parallel to the horizontal portion of the frame with said centers of said holes and notch openings being spaced apart along said plane.

5. The brace of claim 4, wherein:

said locking pin includes a secondary lock opening near the, end opposite to said handle;

said notch is located on the opposite end from said secondary lock opening; said locking pin is sufficiently long such that when said locking pin is disposed in and between said opposing holes, said secondary lock opening extends beyond said channels and said notch is located within said channels.

6. The brace of claim 5, wherein said handle is connected to said locking pin at an angle.

7. The brace of claim 5, wherein there is further included a slip pin clip, said slip pin clip having two sides, one of said sides being sized to fit in said secondary lock opening.

8. The brace of claim 5, wherein said openings are formed in the portion of said sides which form said upper channel.

9. The brace of claim 1, wherein there is further included a set of stability bars mounted in said lower channel of said vertical portion, said stability bars being separated a sufficient distance to permit the vertical portion of the door frame to fit there between.

10. A brace for use in a door frame of a vehicle, the door frame having a horizontal portion and a vertical portion, the brace to be used with an hydraulic ram, comprising:

a frame, said frame having two sides and a cross member connected to each of said sides, each of said sides and cross member having a bend at one end such that said frame has a vertical portion at one end and a horizontal portion at the other end;

said sides being separated sufficiently to fit over the horizontal portion of the door frame and over a vertical portion of the door frame;

a set of stability bars mounted in said vertical portion, said stability bars being separated a sufficient distance to permit the vertical portion of the door frame to fit there between.

11. A brace for use in a door frame of a vehicle, the door frame having a horizontal portion and a vertical portion, the brace to be used with an hydraulic ram which ram includes a foot, comprising:

a frame, said frame having two sides and a cross member connected to each of said sides;

said frame having means for being braced against a horizontal portion of the door frame and a vertical portion of the door frame;

a plurality of sets of opposing openings having centers formed in and extending through each of said sides; brace means associated with said openings for bracing the foot of the hydraulic ram;

lock means for locking said brace means to said frame by action of gravity;

said brace means and said lock means being removable connected with said frame.

12. The brace of claim 11, wherein said brace means includes a locking pin sized to fit through one set of said opposing openings and of sufficient thickness to brace the foot of the hydraulic ram without yielding.

13. The brace of claim 12, wherein said lock means includes:

a plurality of sets of opposing notch openings, one of said notch openings formed in the outer exterior of each of said openings and having a center of curvature and extending through said sides; and said brace means further includes a lock notch formed on one side of said locking pin and sized to fit through a set of such notch openings.

14. The brace of claim 13, wherein said lock means further includes:

a handle connected to said locking pin; and said center of curvature of said notch openings and said centers of said holes being in a plane parallel to the horizontal portion of the frame with said centers of said holes and notch openings being spaced apart along said plane.

15. The brace of claim 14, wherein:

said locking pin includes a secondary lock opening near the end opposite to said handle;

said notch is located on the opposite end from said secondary lock opening;

said locking pin is sufficiently long such that when said locking pin is disposed in and between said opposing openings, said secondary lock opening extends beyond said channels and said notch is located within said channels.

16. The brace of claim 15, wherein there is further included a slip pin clip, said slip pin clip having two sides, one of said sides being sized to fit in said secondary lock opening.

* * * * *